US008008867B2

(12) United States Patent
Jin

(10) Patent No.: US 8,008,867 B2
(45) Date of Patent: Aug. 30, 2011

(54) ARRANGEMENT SUITABLE FOR DRIVING FLOATING CCFL BASED BACKLIGHT

(75) Inventor: Xiaoping Jin, Orange, CA (US)

(73) Assignee: Microsemi Corporation, Garden Grove, CA (US)

( * ) Notice: Subject to any disclaimer, the term of this patent is extended or adjusted under 35 U.S.C. 154(b) by 382 days.

(21) Appl. No.: 12/363,805

(22) Filed: Feb. 2, 2009

(65) Prior Publication Data

US 2009/0195174 A1 Aug. 6, 2009

Related U.S. Application Data

(63) Continuation-in-part of application No. 11/937,693, filed on Nov. 9, 2007, which is a continuation of application No. 10/959,667, filed on Oct. 5, 2004, now Pat. No. 7,294,971.

(60) Provisional application No. 60/508,932, filed on Oct. 6, 2003, provisional application No. 61/026,227, filed on Feb. 5, 2008, provisional application No. 61/055,993, filed on May 25, 2008, provisional application No. 61/114,124, filed on Nov. 13, 2008.

(51) Int. Cl.
*H05B 41/24* (2006.01)

(52) U.S. Cl. ..... 315/277; 315/282; 315/312; 315/209 R; 315/297

(58) Field of Classification Search ..... 315/209 R, 315/209 CD, 244, 282, 297, 277, 177, 246, 315/276, 219, 121, 255, 130, 268, 312
See application file for complete search history.

(56) References Cited

U.S. PATENT DOCUMENTS

| | | | |
|---|---|---|---|
| 2,429,162 | A | 10/1947 | Keiser et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Goto et al. |
| 3,141,112 | A | 7/1964 | Eppert |

(Continued)

FOREIGN PATENT DOCUMENTS

EP 0326114 8/1989

(Continued)

OTHER PUBLICATIONS

Williams, B.W.; "Power Electronics Devices, Drivers, Applications and Passive Components"; Second Edition, McGraw-Hill, 1992; Chapter 10, pp. 218-249.

(Continued)

*Primary Examiner* — Vibol Tan
(74) *Attorney, Agent, or Firm* — Simon Kahn

(57) ABSTRACT

A backlighting arrangement constituted of: a means for receiving an alternating current comprising a first lead and a second lead; at least one luminaire; and at least one first balancing transformer pair each associated with a particular one of the at least one luminaire, the primary of a first balancing transformer of the first balancing transformer pair serially coupled between the first lead of the means for receiving an alternating current and a first end of each of the at least one luminaire, and the primary of a second balancing transformer of the first balancing transformer pair serially coupled between the second lead of the means for receiving an alternating current and a second end of each of the at least one luminaire. The secondaries of all of the at least one first balancing transformer pair are serially connected in a closed in-phase loop.

11 Claims, 8 Drawing Sheets

U.S. PATENT DOCUMENTS 3,565,806 A 2/1971 Ross
3,597,656 A 8/1971 Douglas
3,611,021 A 10/1971 Wallace
3,683,923 A 8/1972 Anderson
3,737,755 A 6/1973 Calkin et al.
3,742,330 A 6/1973 Hodges et al.
3,936,696 A 2/1976 Gray
3,944,888 A 3/1976 Clark
4,060,751 A 11/1977 Anderson
4,353,009 A 10/1982 Knoll
4,388,562 A 6/1983 Josephson
4,441,054 A 4/1984 Bay
4,463,287 A 7/1984 Pitel
4,523,130 A 6/1985 Pitel
4,562,338 A 12/1985 Okami
4,567,379 A 1/1986 Corey et al.
4,572,992 A 2/1986 Masaki
4,574,222 A 3/1986 Anderson
4,622,496 A 11/1986 Dattilo et al.
4,630,005 A 12/1986 Clegg et al.
4,663,566 A 5/1987 Nagano
4,663,570 A 5/1987 Luchaco et al.
4,672,300 A 6/1987 Harper
4,675,574 A 6/1987 Delflache
4,686,615 A 8/1987 Ferguson
4,698,554 A 10/1987 Stupp et al.
4,700,113 A 10/1987 Stupp et al.
4,761,722 A 8/1988 Pruitt
4,766,353 A 8/1988 Burgess
4,780,696 A 10/1988 Jirka
4,847,745 A 7/1989 Shekhawat et al.
4,862,059 A 8/1989 Tominaga et al.
4,893,069 A 1/1990 Harada et al.
4,902,942 A 2/1990 El-Hamamsy
4,939,381 A 7/1990 Shibata et al.
5,023,519 A 6/1991 Jensen
5,030,887 A 7/1991 Guisinger
5,036,255 A 7/1991 McKnight et al.
5,057,808 A 10/1991 Dhyanchand
5,173,643 A 12/1992 Sullivan et al.
5,349,272 A 9/1994 Rector
5,434,477 A 7/1995 Crouse et al.
5,475,284 A 12/1995 Lester et al.
5,485,057 A 1/1996 Smallwood et al.
5,519,289 A 5/1996 Katyl et al.
5,539,281 A 7/1996 Shackle et al.
5,557,249 A 9/1996 Reynal
5,563,473 A 10/1996 Mattas et al.
5,574,335 A 11/1996 Sun
5,574,356 A 11/1996 Parker
5,615,093 A 3/1997 Nalbant
5,619,402 A 4/1997 Lin
5,621,281 A 4/1997 Kawabata et al.
5,652,479 A 7/1997 LoCascio et al.
5,712,776 A 1/1998 Palara et al.
5,754,012 A 5/1998 LoCascio et al.
5,818,172 A 10/1998 Lee
5,822,201 A 10/1998 Kijima
5,825,133 A 10/1998 Conway
5,828,156 A 10/1998 Roberts
5,854,617 A 12/1998 Lee et al.
5,892,336 A 4/1999 Lin et al.
5,910,713 A 6/1999 Nishi et al.
5,912,812 A 6/1999 Moriarty, Jr.
5,914,842 A 6/1999 Sievers
5,923,129 A 7/1999 Henry
5,930,121 A 7/1999 Henry
5,930,126 A 7/1999 Griffin et al.
5,936,360 A 8/1999 Kaneko
6,002,210 A 12/1999 Nilssen
6,020,688 A 2/2000 Moisin
6,028,400 A 2/2000 Pol et al.
6,037,720 A 3/2000 Wong et al.
6,038,149 A 3/2000 Hiraoka et al.
6,040,662 A 3/2000 Asayama
6,043,609 A 3/2000 George et al.
6,049,177 A 4/2000 Felper
6,072,282 A 6/2000 Adamson
6,104,146 A 8/2000 Chou et al.
6,108,215 A 8/2000 Kates et al.
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,150,772 A 11/2000 Crane
6,169,375 B1 1/2001 Moisin
6,181,066 B1 1/2001 Adamson
6,181,083 B1 1/2001 Moisin
6,181,084 B1 1/2001 Lau
6,188,553 B1 2/2001 Moisin
6,198,234 B1 3/2001 Henry
6,198,236 B1 3/2001 O'Neill
6,215,256 B1 4/2001 Ju
6,218,788 B1 4/2001 Chen et al.
6,259,615 B1 7/2001 Lin
6,281,636 B1 8/2001 Okutsu et al.
6,281,638 B1 8/2001 Moisin
6,307,765 B1 10/2001 Choi
6,310,444 B1 10/2001 Chang
6,316,881 B1 11/2001 Shannon et al.
6,320,329 B1 11/2001 Wacyk
6,323,602 B1 11/2001 De Groot et al.
6,344,699 B1 2/2002 Rimmer
6,362,577 B1 3/2002 Ito et al.
6,396,722 B2 5/2002 Lin
6,417,631 B1 7/2002 Chen et al.
6,420,839 B1 7/2002 Chiang et al.
6,433,492 B1 8/2002 Buonavita
6,441,943 B1 8/2002 Roberts et al.
6,445,141 B1 9/2002 Kastner et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,486,618 B1 11/2002 Li
6,494,587 B1 12/2002 Shaw et al.
6,501,234 B2 12/2002 Lin et al.
6,509,696 B2 1/2003 Bruning et al.
6,515,427 B2 2/2003 Oura et al.
6,515,881 B2 2/2003 Chou et al.
6,522,558 B2 2/2003 Henry
6,531,831 B2 3/2003 Chou et al.
6,534,934 B1 3/2003 Lin et al.
6,559,606 B1 5/2003 Chou et al.
6,570,344 B2 5/2003 Lin
6,628,093 B2 9/2003 Stevens
6,633,138 B2 10/2003 Shannon et al.
6,680,834 B2 1/2004 Williams
6,717,371 B2 4/2004 Klier et al.
6,717,372 B2 4/2004 Lin et al.
6,765,354 B2 7/2004 Klein et al.
6,781,325 B2 8/2004 Lee
6,784,627 B2 8/2004 Suzuki et al.
6,804,129 B2 10/2004 Lin
6,864,867 B2 3/2005 Biebl
6,870,330 B2 3/2005 Choi
6,922,023 B2 7/2005 Hsu et al.
6,930,893 B2 8/2005 Vinciarelli
6,936,975 B2 8/2005 Lin et al.
7,023,145 B2 * 4/2006 Hwang et al. ..... 315/276
7,187,139 B2 3/2007 Jin
7,411,358 B2 8/2008 Shimura
7,446,485 B2 11/2008 Huang
7,560,875 B2 * 7/2009 Jin ..... 315/277
7,723,996 B2 * 5/2010 Lee et al. ..... 324/537
7,777,425 B2 * 8/2010 Hsu et al. ..... 315/282
7,872,424 B2 * 1/2011 Sun et al. ..... 315/219
7,876,055 B2 * 1/2011 Hosaka et al. ..... 315/277
2001/0036096 A1 11/2001 Lin
2002/0030451 A1 3/2002 Moisin
2002/0097004 A1 7/2002 Chiang et al.
2002/0135319 A1 9/2002 Bruning et al.
2002/0140538 A1 10/2002 Yer et al.
2002/0145886 A1 10/2002 Stevens
2002/0171376 A1 11/2002 Rust et al.

| | | | | |
|---|---|---|---|---|
| 2002/0180380 | A1 | 12/2002 | Lin | |
| 2002/0180572 | A1 | 12/2002 | Kakehashi et al. | |
| 2002/0181260 | A1 | 12/2002 | Chou et al. | |
| 2002/0195971 | A1 | 12/2002 | Qian et al. | |
| 2003/0001524 | A1 | 1/2003 | Lin et al. | |
| 2003/0015974 | A1 | 1/2003 | Klier et al. | |
| 2003/0080695 | A1 | 5/2003 | Ohsawa | |
| 2003/0090913 | A1 | 5/2003 | Che-Chen et al. | |
| 2003/0117084 | A1 | 6/2003 | Stack | |
| 2003/0141829 | A1 | 7/2003 | Yu et al. | |
| 2004/0032223 | A1 | 2/2004 | Henry | |
| 2004/0155596 | A1 | 8/2004 | Ushijima et al. | |
| 2004/0257003 | A1 | 12/2004 | Hsieh et al. | |
| 2004/0263092 | A1 | 12/2004 | Liu | |
| 2005/0093471 | A1* | 5/2005 | Jin | 315/177 |
| 2005/0093472 | A1 | 5/2005 | Jin | |
| 2005/0093482 | A1 | 5/2005 | Ball | |
| 2005/0093483 | A1 | 5/2005 | Ball | |
| 2005/0093484 | A1* | 5/2005 | Ball | 315/291 |
| 2005/0099143 | A1 | 5/2005 | Kohno | |
| 2005/0156539 | A1 | 7/2005 | Ball | |
| 2005/0162098 | A1 | 7/2005 | Ball | |
| 2005/0225261 | A1 | 10/2005 | Jin | |
| 2006/0022612 | A1 | 2/2006 | Henry | |
| 2006/0061982 | A1* | 3/2006 | Lee | 362/29 |

FOREIGN PATENT DOCUMENTS

| | | | |
|---|---|---|---|
| EP | 0587923 | | 3/1994 |
| EP | 0597661 | | 5/1994 |
| EP | 0647021 | A1 | 9/1994 |
| EP | 0838272 | A2 | 4/1998 |
| EP | 1796440 | A2 | 6/2007 |
| JP | 5-90897 | | 12/1993 |
| JP | 06168791 | A | 6/1994 |
| JP | 06181095 | A | 6/1994 |
| JP | 8-204488 | | 8/1996 |
| JP | 11238589 | A | 8/1999 |
| JP | 11305196 | A | 11/1999 |
| JP | 2000030880 | A | 1/2000 |
| JP | 2002367835 | A | 12/2002 |
| TW | 485701 | | 5/2002 |
| TW | 556860 | | 1/2003 |
| TW | 0554643 | | 9/2003 |
| TW | 200501829 | | 1/2005 |
| WO | WO 94/15444 | | 7/1994 |
| WO | WO 96/38024 | | 11/1996 |

OTHER PUBLICATIONS

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

Supplementary European Search Report for Application No. EP 04794179, dated May 15, 2007.

Examination Report for Application No. EP 04794179, dated Oct. 16, 2007.

International Search Report and Written Opinion PCT/US2009/032787.

Taiwan Examination Report for Application No. 094110958, dated Mar. 20, 2008, 9 pages.

* cited by examiner

ARRANGEMENT SUITABLE FOR DRIVING FLOATING CCFL BASED BACKLIGHT

CROSS-REFERENCE TO RELATED APPLICATIONS

This application claims priority from U.S. Provisional Patent Application Ser. No. 61/026,227 filed Feb. 5, 2008, U.S. Provisional Patent Application Ser. No. 61/055,993 filed May 25, 2008 and U.S. Provisional Patent Application Ser. No. 61/114,124 filed Nov. 13, 2008, the entire contents of all of which is incorporated herein by reference. This application is related to co-filed U.S. patent application Ser. No. 12/363,806 entitled "Direct Coupled Balancer Drive for Floating Lamp Structure" and co-filed U.S. patent application Ser. No. 12/363,807 entitled "Balancing Arrangement with Reduced Amount of Balancing Transformers", the entire contents of each of which is incorporated herein by reference. This application is a continuation in part of pending U.S. patent application Ser. No. 11/937,693 filed Nov. 9, 2007.

BACKGROUND OF THE INVENTION

The present invention relates to the field of cold cathode fluorescent lamp based lighting and more particularly to an arrangement in which balancing transformers are supplied at each end of the lamp.

Fluorescent lamps are used in a number of applications including, without limitation, backlighting of display screens, televisions and monitors. One particular type of fluorescent lamp is a cold cathode fluorescent lamp (CCFL). Such lamps require a high starting voltage (typically on the order of 700 to 1,600 volts) for a short period of time to ionize a gas contained within the lamp tubes and fire or ignite the lamp. This starting voltage may be referred to herein as a strike voltage or striking voltage. After the gas in a CCFL is ionized and the lamp is fired, less voltage is needed to keep the lamp on.

In liquid crystal display (LCD) applications, a backlight is needed to illuminate the screen so as to make a visible display. Backlight systems in LCD or other applications typically include one or more CCFLs and an inverter system to provide both DC to AC power conversion and control of the lamp brightness. Even brightness across the panel and clean operation of inverters with low switching stresses, low EMI, and low switching losses is desirable.

The lamps are typically arranged with their longitudinal axis proceeding horizontally. In general, even brightness involves two dimensions: uniform brightness in the vertical dimension, i.e. among the various lamps; and uniform brightness along the longitudinal axis of each of the various lamps in the horizontal dimension. Brightness uniformity in the vertical dimension is largely dependent on matching the lamp currents which normally requires a certain type of balancing technique to maintain an even lamp current distribution. U.S. Pat. No. 7,242,147 issued Jul. 10, 2007 to Jin, entitled "Current Sharing Scheme for Multiple CCFL Lamp Operation", the entire contents of which is incorporated herein by reference, is addressed to a ring balancer comprising a plurality of balancing transformers which facilitate current sharing in a multi-lamp backlight system thus providing even lamp current distribution.

Brightness uniformity in the horizontal dimension is impacted by the existence of parasitic capacitance between the CCFLs and the chassis. As a result of the parasitic capacitance, leakage current exists along the length of the lamps and such leakage further results in diminishing brightness along the lamps' longitudinal axis towards the cold end in a single ended drive architecture. The term single ended drive architecture refers to a backlight arrangement in which the high voltage drive power is applied from only one side of the lamp, which is usually called the 'hot' end, and the other side of the lamp is normally at ground potential and referred as the 'cold' end. With the increasing size of LCD televisions and monitors, increases in lamp length, wire length and operating voltage associated with the resultant large backlighting systems make the leakage effect more significant, and consequently uniform horizontal brightness across lamps arranged in a single ended drive architecture is more difficult to achieve. In order to obtain even horizontal brightness for each of the CCF lamps, i.e. that the lamps should not exhibit a light gradient along its longitudinal axis, energy has to be alternatively driven into each end of the lamp. Thus, most large backlight inverter systems are configured to support 'floating' lamp structures, in which both lamp terminals are connected to a high voltage driving source, with a 180° phase shift to each other, and floating in relation to the chassis ground plane.

As described above, a factor in achieving even brightness over a CCFL is the ability to symmetrically power the lamp alternatively at both ends. This is more difficult to achieve as the length of the lamp increases. Among the conventional inverter topologies, a phase shifted full-bridge topology and a resonant full-bridge topology are most commonly used for CCFL inverter applications because of their ability to produce symmetric lamp current waveforms and clean switching operations.

U.S. Pat. No. 7,187,139 issued Mar. 6, 2007 to Jin, entitled "Split Phase Inverters for CCFL Backlight System", the entire contents of which is incorporated herein by reference, is addressed to an inverter arrangement in which the switching elements are split into two inverter arms that are deployed at separate terminals of a floating lamp structure. Such a concept provides even brightness across the longitudinal dimension of the lamps with lower cost compared with the conventional approach of deploying a full bridge circuit at each end of the lamps, while maintaining the advantages of soft switching operation of the full bridge. Unfortunately, separate inverter circuits are still needed to develop driving power at both ends of the lamp, and in addition, wiring of power cables and control signals could lead to potential electromagnetic interference issues, in particular as high voltage signals traversing the chassis length exhibitive capacitive coupling to the chassis. Often, a reflective material is disposed behind the lamps, typically based on metal, the metal based reflective material further adding to the capacitive coupling.

What is further desired, and not provided by the prior art, is a backlighting arrangement that can provide even luminance across each lamp in the system, preferably with only one inverter circuit, and further preferably where there is no high voltage or high switching current wiring across the horizontal length of the panel.

SUMMARY OF THE INVENTION

Accordingly, it is a principal object of the present invention to overcome at least some of the disadvantages of the prior art. This is provided in certain embodiments by a backlighting arrangement in which pairs of balancing transformers are provided, each associated with a particular luminaire. The primary winding of each of the balancing transformers is coupled in series with a respective end of the associated luminaire. The secondary windings of the balancing transformers are connected in a single closed loop, and arranged to be in-phase.

In one exemplary embodiment, the luminaires each comprise a pair of lamps, and an additional pair of balancing transformers is provided associated with each pair of lamps. The primary windings of the additional pair are coupled in series and between the lamps. The secondary windings of the additional pair are connected in-phase within the single closed loop. The luminaire is connected across an AC power source, such as an inverter or a single ended AC power source, and the nexus of the pair of lamps not directly connected to the AC power source receives energy via the balancing transformers thereby providing even brightness.

The present embodiments enable a backlighting arrangement comprising: a first lead and a second lead arranged to receive and return an alternating current; at least one luminaire; and at least one first balancing transformer pair each of the transformer pair associated with a particular one of the at least one luminaire, the primary winding of a first balancing transformer of each of the first balancing transformer pair serially coupled between the first lead and a first end of the associated at least one luminaire, and the primary winding of a second balancing transformer of each of the first balancing transformer pair serially coupled between the second lead and a second end of each of the associated at least one luminaire, wherein the secondary windings of all of the at least one first balancing transformer pair are serially connected in a closed in-phase loop.

In one embodiment at least one of the at least one luminaire comprises a serially connected pair of linear lamps. In another embodiment at least one of the at least one luminaire comprises a U-shaped lamp.

In one embodiment at least one of the at least one luminaire comprises a single linear lamp. In another embodiment, the backlighting arrangement further comprises a differential alternating current source arranged to supply power to the at least one luminaire via the first and second leads. In yet another embodiment the at least one luminaire comprises a plurality of luminaires.

In one embodiment the backlighting arrangement further comprises a single ended alternating current source arranged to supply power to the at least one luminaire via the first and second leads, wherein the first lead is connected to the single ended alternating current source, and the second lead is connected to a ground connection. In yet another embodiment, the backlighting arrangement further comprises a sense resistor serially connected within the serially connected closed in-phase loop arranged to present a voltage drop representation of the current flowing through the closed in-phase loop.

In one embodiment the backlighting arrangement further comprises at least one second balancing transformer pair each of the second transformer pair associated with a particular one of the at least one luminaire and wherein each of the at least one luminaire comprises a pair of linear lamps each exhibiting a far end removed from each of the first and second ends of the luminaire, the primary windings of the second balancing transformer pair being arranged in series and serially coupled between the far ends of associated pair of linear lamps, the secondary windings of the second balancing transformer pair being serially connected in-phase in the closed in-phase serial loop. In one further embodiment the backlighting arrangement further comprises a differential alternating current source arranged to supply power to the at least one luminaire via the first and second leads. In another further embodiment the backlighting arrangement further comprises a single ended alternating current source arranged to supply power to the at least one luminaire via the means for first and second leads, wherein the first lead is connected to the single ended alternating current source, and the second lead is connected to a ground connection. In yet another further embodiment the backlighting arrangement further comprises a sense resistor serially connected within the serially connected closed in-phase loop arranged to present a voltage drop representation of the current flowing through the closed in-phase loop.

In one embodiment each of the at least one luminaire comprises a pair of linear lamps each exhibiting a far end removed from each of the first and second ends of the luminaire, the arrangement further comprising at least one second balancing transformer each associated with a particular one of the pair of linear lamps, the primary windings of each of the second balancing transformer being coupled between the far ends of the associated pair of linear lamps, the secondary windings of the second balancing transformer being serially connected in-phase in the closed in-phase serial loop. In one further embodiment the at least one pair of linear lamps are arranged substantially in parallel to backlight a display, and wherein the serially connected closed in-phase loop exhibits a single twisted wire pair connecting a portion of the closed in-phase loop associated with a first end of the display to a portion of the closed in-phase loop associated with a second end of the display opposing the first end of the display.

The present embodiments independently provide for a method of driving at least one luminaire, comprising: receiving an alternating current; providing at least one luminaire; and providing a first balancing transformer pair associated with each of the provided at least one luminaire, the primary winding of a first transformer of the respective balancing transformer pair associated with a first end of the associated luminaire, and the primary winding of a second transformer of the particular balancing transformer pair associated with a second end of the associated luminaire; coupling the received alternating current via the primary windings of the first balancing transformer pair to each end of the provided at least one luminaire; and arranging the secondary windings of all of the provided at least one first balancing transformer pair in a serially connected closed in-phase loop.

In one embodiment at least one of the provided at least one luminaire comprises a serially connected pair of linear lamps. In another embodiment, at least one of the provided at least one luminaire comprises a U-shaped lamp.

In one embodiment at least one of the provided at least one luminaire comprises a single linear lamp. In another embodiment the method further comprises sensing a current flowing through the closed in-phase loop.

In one embodiment each of the provided at least one luminaire comprises a pair of linear lamps each exhibiting a far end removed from each of the first and second ends of the luminaire, the method further comprising: providing at least one second balancing transformer pair, each balancing transformer of the pair associated with a particular one of the provided at least one luminaire; arranging the primary windings of the second balancing transformer pair in series and serially connecting the series arranged primary windings between the far ends of the associated pair of linear lamps; and arranging the secondary windings of the provided at least one second balancing transformer pair in the serially connected closed in-phase loop. In one further embodiment the method further comprises sensing a current flowing through the closed in-phase loop.

In one embodiment each of the provided at least one luminaire comprises a pair of linear lamps each exhibiting a far end removed from each of the first and second ends of the luminaire, the method further comprising: providing at least one second balancing transformer; serially connecting the primary winding of one of the provided at least one second balancing transformer between the far ends of the associated pair of linear lamps; and arranging the secondary windings of the provided at least one second balancing transformer in the serially connected closed in-phase loop.

The present embodiment independently provide for a backlighting arrangement comprising: a means for receiving an alternating current exhibiting a first lead and a second lead; a plurality of luminaires; and a plurality of first balancing transformer pairs each associated with a particular one of the plurality of luminaires, the primary winding of a first balancing transformer of each of the first balancing transformer pair serially coupled between the first lead of the means for receiving an alternating current and a first end of the associated luminaire, and the primary winding of a second balancing transformer of each of the first balancing transformer pair serially coupled between the second lead of the means for receiving an alternating current and a second end of the associated luminaire, wherein the secondary windings of all of the at least one first balancing transformer pair are serially connected in a closed in-phase loop.

In one embodiment the backlighting arrangement further comprises a plurality of second balancing transformer pairs each associated with a particular one of the plurality of luminaires and wherein each of the plurality of luminaires comprises a pair of lamps each exhibiting a far end removed from each of the first and second ends of the luminaire, the primary windings of the associated second balancing transformer pair being arranged in series and serially connected between the far ends of the pair of linear lamps, the secondary windings of the second balancing transformer pair being serially connected in-phase in the closed in-phase serial loop.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1A:
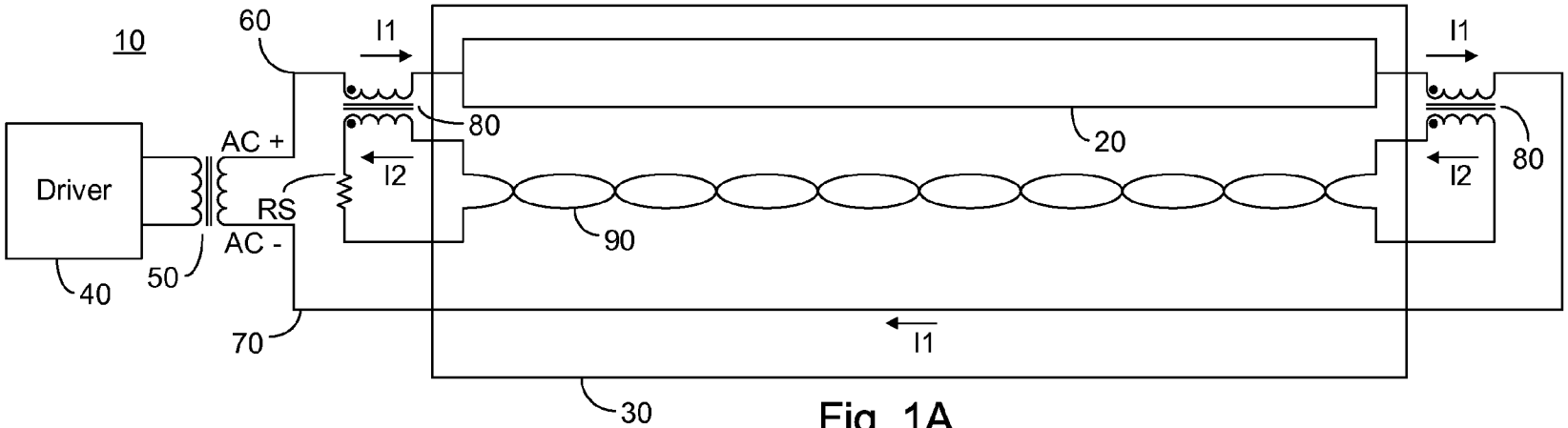
FIG. 1A illustrates a high level block diagram of an exemplary embodiment of a floating lighting arrangement comprising a luminaire constituted of a single lamp.

Certain of the present embodiments enable a backlighting arrangement in which pairs of balancing transformers are provided, each associated with a particular luminaires The primary winding of each of the balancing transformers is coupled in series with a respective end of the associated luminaires The secondary windings of the balancing transformers are connected in a single closed loop, and arranged to be in-phase.

In one exemplary embodiment, the luminaires each comprise a pair of lamps, and an additional pair of balancing transformers is provided associated with each pair of lamps. The primary windings of the additional pair are coupled in series and between the lamps. The secondary windings of the additional pair are connected in-phase within the single closed loop. The luminaire is connected across an AC power source, such as an inverter or a single ended AC power source, and the nexus of the pair of lamps not directly connected to the AC power source receives energy via the balancing transformer thereby providing even brightness.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1A illustrates a high level block diagram of an exemplary embodiment of a floating lighting arrangement 10 comprising a single luminaire, constituted of a lamp 20, arranged to backlight a display 30. Display 30 is typically constituted of a metal based chassis. Floating lighting arrangement 10 further comprises: a driver 40; a driving transformer 50 exhibiting a first output 60 and a second output 70; a first and a second balancing transformer 80; and a twisted wire pair 90. The outputs of driver 40 are connected to both ends of the primary winding of driving transformer 50. The first end of the secondary winding of driving transformer 50, denoted first output 60, is connected to the first end of the primary winding of first balancing transformer 80. The second end of the primary winding of first balancing transformer 80 is connected to the first end of lamp 20. The second end of lamp 20 is connected to the first end of the primary winding of second balancing transformer 80, and the second end of the primary winding of second balancing transformer 80 is connected the second end of the secondary winding of driving transformer 50, denoted second output 70. The secondary windings of first and second balancing transformers 80 are connected in a closed serial loop, the serial loop further comprising a sense resistor RS. The polarity of the secondary windings of first and second balancing transformers 80 are arranged so that voltages induced in the secondary windings are in phase and add within the closed loop. Optionally, the wires of the closed loop connecting the secondary windings of first and second balancing transformers 80 are arranged via a twisted wire pair 90.

Preferably, the first end of lamp 20 is in physical proximity of driving transformer 50, e.g. on the same side of display 30 typically constituted of a metal based chassis, as driving transformer 50, and in physical proximity of first balancing transformer 80, and preferably generally define a first plane. Preferably, lamp 20, typically constituted of a linear lamp, generally extends axially away from the proximity of driving transformer 50, and generally defines a second plane, further preferably orthogonal to the first plane.

In operation, driver 40, which in one embodiment comprises a direct drive backlight driver as described in U.S. Pat. No. 5,930,121 issued Jul. 27, 1999 to Henry, entitled "Direct Drive Backlight System", the entire contents of which is incorporated herein by reference, provides a differential AC source via driving transformer 50. In one further embodiment the secondary of driving transformer 50 is allowed to float. For simplicity, we designate first output 60 as AC+ and second output 70 as AC−, which is appropriate for ½ the drive cycle. During the second half of the drive cycle, polarity is reversed and the direction of current flow is reversed.

A current I1 is developed through the primary winding of first balancing transformer 80, responsive to AC+ at first output 60, and driven through lamp 20. Current I1 proceeds via the primary winding of second balancing transformer 80 and is returned to AC− at second output 70. Current I2 is developed in the secondary of first balancing transformer 80, responsive to I1, and flows via sense resistor RS and a first wire of twisted wire pair 90 to the secondary of second balancing transformer 80. The voltage developed across the secondary of second balancing transformer 80 is in phase in the closed loop with the voltage developed across the secondary of first balancing transformer 80, and thus current I2 continues through the secondary of second balancing transformer 80 and is returned via a second wire of twisted wire pair 90.

Advantageously, in a preferred embodiment the turns ratio of each of first and second balancing transformers 80 are such that twisted wire pair 90 exhibits low voltage and high current, thereby reducing any capacitive coupling to the constituent chassis of display 30. The use of twisted wire pair 90, exhibiting similar current and voltage with reverse polarity in each of the constituent wires further reduces any electromagnetic interference caused by twisted wire pair 90 traversing the length of display 30.

As described above, the secondary windings of first and second balancing transformers 80 are serially connected in a closed loop, and thus the current circulating in each of the secondary windings is substantially equal. If the magnetizing currents of the balancing transformers are neglected, the following relationship can be established for each of the balancing transformers:

$$N_{P1} \cdot I1 = N_{S1} \cdot I2;\ N_{P2} \cdot I1 = N_{S2} \cdot I2; \qquad \text{EQ. 1}$$

$N_{P1}$ and I1 denote the primary turns and primary current respectively of first balancing transformer 80; $N_{S1}$ and I2 denote the secondary turns and secondary current respectively of first balancing transformer 80; $N_{P2}$ and I1 denote the primary turns and primary current respectively of second balancing transformer 80; and $N_{S2}$ and I2 denote the secondary turns and secondary current respectively of second balancing transformer 80. Solving for I1 and I2 of EQ. 1 results in:

$$I1 = (N_{S1}/N_{P1}) \cdot I2 = (N_{S2}/N_{P2}) \cdot I2 \qquad \text{EQ. 2}$$

Thus, in accordance with EQ. 2, the secondary current sensed by the voltage drop across sense resistor RS, is a function of the primary current and the turns ratio of the balancing transformers 80. Sense resistor RS is advantageously not connected to the high voltage associated with first and second outputs 60, 70, and thus may be connected to a low voltage controller to sense the current through lamp 20.

Current I2 connected via the closed loop of the secondary windings, ensures that the current I1 entering the first end of lamp 20 is substantially equal to current I1 leaving the second end of lamp 20.

Figure 1B:
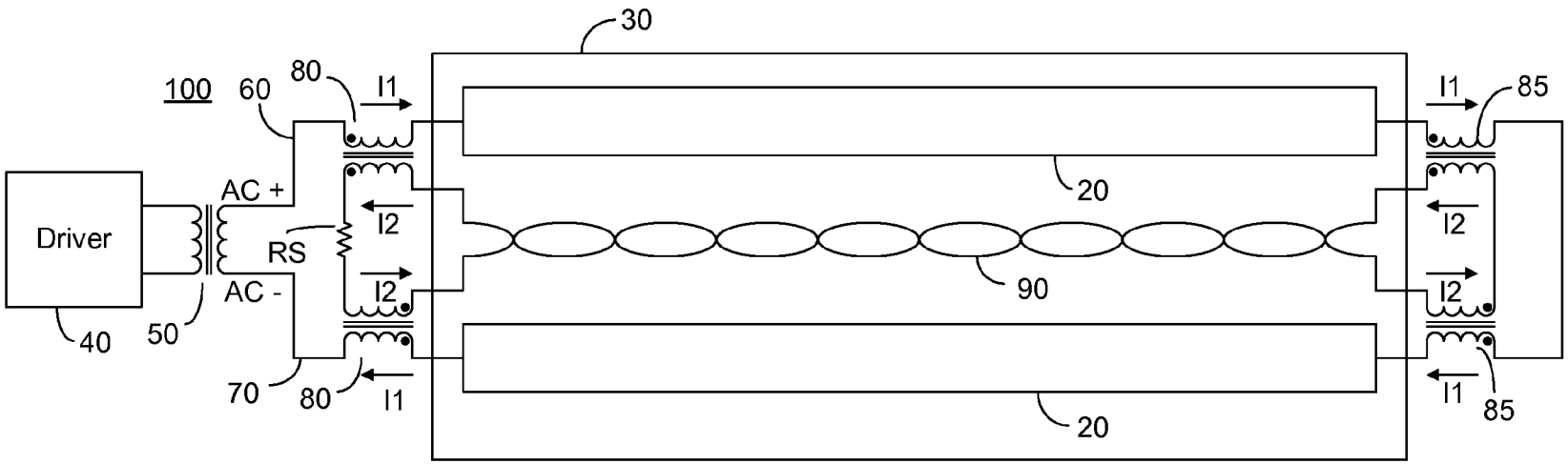
FIG. 1B illustrates a high level block diagram of an exemplary embodiment of a floating lighting arrangement comprising a luminaire constituted of a pair of lamps.

FIG. 1B illustrates a high level block diagram of an exemplary embodiment of a floating lighting arrangement 100 constituted of a pair of linear lamps 20, arranged to backlight a display 30. Floating lighting arrangement 100 further comprises: a driver 40; a driving transformer 50 exhibiting a first output 60 and second output 70; a first and a second balancing transformer 80; a first and a second balancing transformer 85; and a twisted wire pair 90. Balancing transformers 80 and 85 may be of identical type without exceeding the scope of the invention.

The outputs of driver 40 are connected to both ends of the primary winding of driving transformer 50. The first end of the secondary winding of driving transformer 50, denoted first output 60, is connected to the first end of the primary winding of first balancing transformer 80. The second end of the primary winding of first balancing transformer 80 is connected to the first end of first lamp 20. The second end of first lamp 20 is connected to the first end of the primary winding of first balancing transformer 85, and the second end of the primary winding of first balancing transformer 85 is connected the first end of the primary winding of second balancing transformer 85. The second end of the primary winding of second balancing transformer 85 is connected to the first end of second lamp 20. The second end of second lamp 20 is connected to the first end of the primary winding of second balancing transformer 80 and the second end of the primary winding of second balancing transformer 80 is connected to the second end of the secondary winding of driving transformer 50, denoted second output 70.

The secondary windings of first and second balancing transformers 80 and the secondary windings of first and second balancing transformers 85 are connected in a single closed serial loop via a sense resistor RS. The polarity of the secondary windings of the first and second balancing transformers 80 and the secondary windings of the first and second balancing transformers 85 are arranged so that voltages induced in the secondary windings are in phase and add within the serial closed loop. Optionally, the wires of the closed loop connecting the respective ends of the secondary windings of the first and second balancing transformers 80 to respective ends of the secondary windings of the first and second balancing transformers 85 are arranged via a twisted wire pair 90.

Preferably, the first end of first lamp 20 and the second end of second lamp 20 are in physical proximity of driving transformer 50, e.g. on the same side of display 30 typically constituted of a metal based chassis, as driving transformer 50, and in physical proximity of first and second balancing transformers 80, and preferably generally define a first plane. Preferably, first and second lamps 20, each typically constituted of a linear lamp, generally extend axially away from the proximity of driving transformer 50, and generally define a second plane, further preferably orthogonal to the first plane.

In operation, driver 40 provides a differential AC source via driving transformer 50. In one further embodiment the secondary of driving transformer 50 is allowed to float. For simplicity, we designate first output 60 as AC+ and second output 70 as AC−, which is appropriate for ½ the drive cycle. During the second half of the drive cycle, polarity is reversed and the direction of current flow is reversed.

A current I1 is developed through the primary winding of first balancing transformer 80, responsive to AC+ at first output 60, and driven through first lamp 20. Current I1 proceeds through the primary winding of first balancing transformer 85, through the primary winding of second balancing transformer 85, through second lamp 20, through the primary winding of second balancing transformer 80 and is returned to AC− at second output 70. As described above, the secondary windings of first and second balancing transformers 80 and first and second balancing transformers 85 are serially connected in a closed loop, and thus current I2 circulating in each of the secondary windings is substantially equal. If the magnetizing currents of the balancing transformers are neglected, the following relationship can be established for each of the balancing transformers:

$$N_{P1}\cdot I_{P1}=N_{S1}\cdot I_{S1};\ N_{P2}\cdot I_{P2}=N_{S2}\cdot I_{S2};\ N_{P3}\cdot I_{P3}=N_{S3}\cdot I_{S3};\ N_{P4}\cdot I_{P4}=N_{S4}\cdot I_{S4}; \quad \text{EQ. 3}$$

$N_{P1}$ and $I_{P1}$ of EQ. 3 denote the primary turns and primary current respectively of first balancing transformer 80; $N_{S1}$ and $I_{S1}$ denote the secondary turns and secondary current respectively of first balancing transformer 80; $N_{P1}$ and $I_{P2}$ denote the primary turns and primary current respectively of first balancing transformer 85; $N_{S2}$ and $I_{S2}$ denote the secondary turns and secondary current respectively of first balancing transformer 85; $N_{P3}$ and $I_{P3}$ denote the primary turns and primary current respectively of second balancing transformer 85; $N_{S3}$ and $I_{S3}$ denote the secondary turns and secondary current respectively of second balancing transformer 85; $N_{P4}$ and $I_{P4}$ denote the primary turns and primary current respectively of second balancing transformer 80; and $N_{S4}$ and $I_{S4}$ denote the secondary turns and secondary current respectively of second balancing transformer 80. Solving for each of the primary currents results in:

$$I_{P1}=(N_{S1}/N_{P1})\cdot I_{S1};\ I_{P2}=(N_{S2}/N_{P2})\cdot I_{S2};\ I_{P3}=(N_{S3}/N_{P3})\cdot I_{S3};\ I_{P4}=(N_{S4}/N_{P4})\cdot I_{S4}; \quad \text{EQ. 4}$$

From EQ. 4 it is obvious that the primary current and hence the lamp current conducted by the respective lamps can be controlled proportionally with the turns ratio ($N_{S1}/N_{P1}$, $N_{S2}/N_{P2}$ . . . $N_{SK}/N_{PK}$) of the balancing transformers. Physically, if any current in a particular balancing transformer deviates from the relationships defined in EQ. 4, the resulting magnetic flux from the error ampere turns will induce a corresponding correction voltage in the primary winding to force the primary current to follow the balancing condition of EQ. 4. A balanced lamp current condition between first lamp 20 and second lamp 20 can be thus obtained by using the same primary to secondary turns ratio for all the balancing transformers 80, 85.

Further, because the secondary loop current is proportional to the primary side lamp current according to EQ. 4, lamp current can also be detected by sense resistor RS in the secondary winding loop and measured responsive to voltage drop across sense resistor RS. Because the secondary windings of balancing transformers 80, 85 are isolated from the lamp high voltage side, the signal from sense resistor RS can be fed to a low voltage controller circuit directly for regulation and monitoring purposes. Such application is especially useful with a floating lamp configuration, such as floating lighting arrangement 100, where no ground potential node is available in the lamp circuit for direct current sensing.

Coupling the secondary windings of the balancing transformers 80, 85 in a closed loop also couples energy between balancing transformers 80, 85 through the circulating current in the secondary winding loop. The energies needed to drive the far end of first and second lamps 20 are coupled by this mechanism through balancing transformers 85. Under such circumstances the balancing error of the lamp current is related to the lamp operating voltage and the magnetizing inductance of the balancing transformer as described below under steady state operating condition:

$$\Delta I=V/(\omega Lm) \quad \text{EQ. 5}$$

Where ΔI represents the balancing error, i.e. the difference of the lamp current from the lamp terminals, ω is the angular frequency of the AC source, Lm is the magnetizing inductance from the primary side of the balancer, and V is the lamp operating voltage.

With such an arrangement, there is no requirement for an inverter circuit, or inverter arms, driving the far ends of first and second lamp 20, resulting in a significant cost savings since the driving current is supplied via the secondary winding loop. Advantageously, there are only two wires extending across display 30, in line with the longitudinal axes of first and second lamps 20, to form the loop connection of the balancer secondary windings. Because current 12 flowing in the two wires has equal amplitude and opposite direction, the two wires can be brought to one edge of display 30 and twisted together to yield minimum electro-magnetic field interference, as illustrated by twisted wire pair 90. Further, because the voltage in secondary windings of transformer balancers may be set to be very low responsive to an appropriate turns ratio, the twisted wire pair does not produce any high capacitive leakage current and associated interference.

Figure 2:
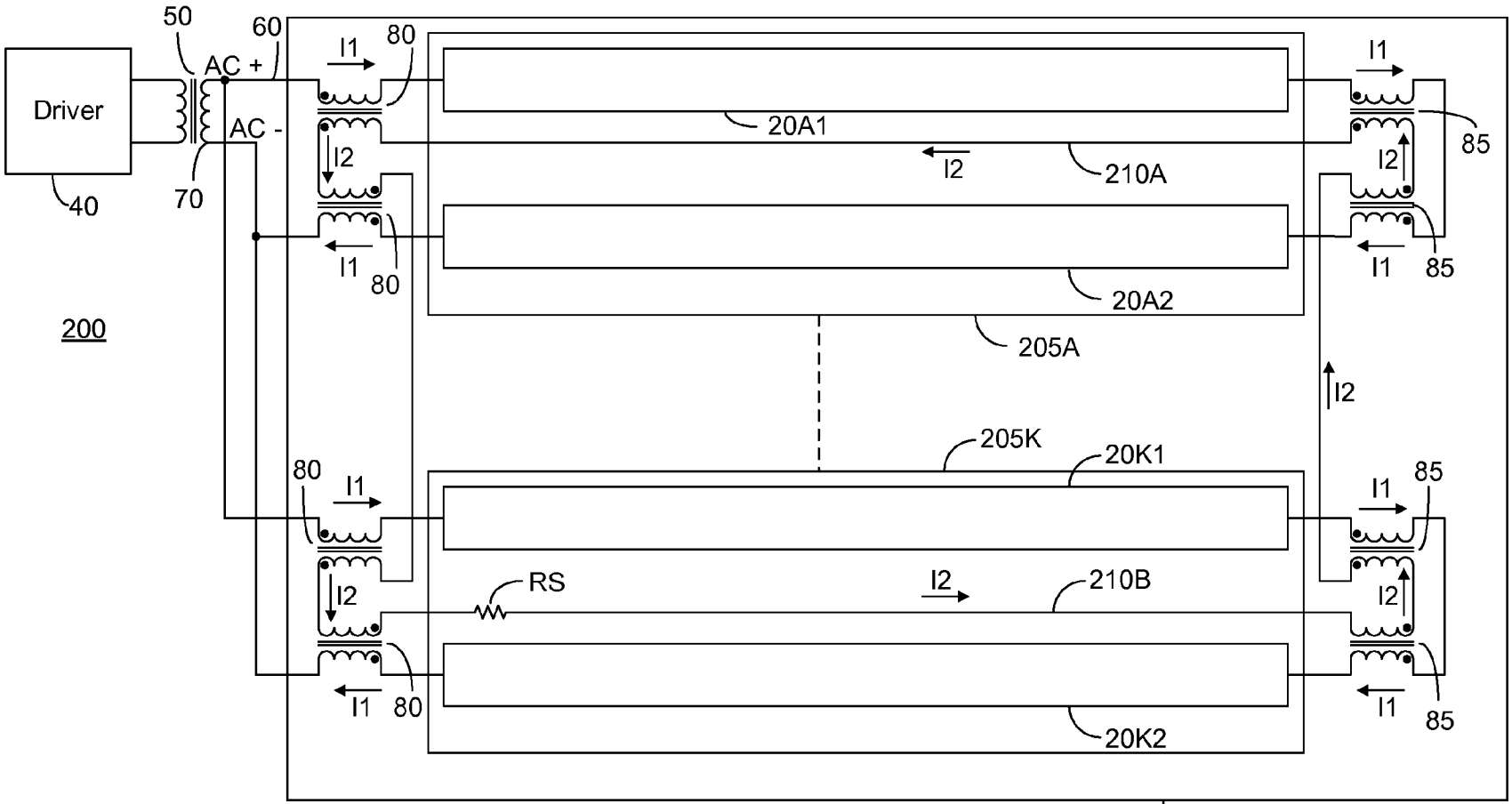
FIG. 2 illustrates a high level block diagram of an exemplary embodiment of a floating lighting arrangement comprising a plurality of luminaires, each constituted of a serially connected linear lamp pair, and a differential AC source in which energy is supplied to the far side of each of the lamps by a balancing network.

FIG. 2 illustrates a high level block diagram of an exemplary embodiment of a floating lighting arrangement 200 arranged to backlight a display 30 comprising a plurality of luminaires 205A . . . 205K, each constituted of a pair of serially arranged linear lamps 20A1, 20A2 . . . 20K1, 20K2, and a differential AC source in which energy is supplied to the far side of each of the lamps by a balancing network. Floating lighting arrangement 200 further comprises: a driver 40; a driving transformer 50 exhibiting a first output 60 and a second output 70; a plurality of balancing transformers 80; a plurality of balancing transformers 85; and a wire pair 210A, 210B. Each luminaire 205A, . . . , 205K has associated therewith a balancing transformer 80 associated with a first end thereof and a balancing transformer 80 associated with a second end thereof. Each luminaire 205A, . . . , 205K has further associated therewith a pair of balancing transformers 85 serially connected between the far ends of the constituent linear lamps 20A1, 20A2 . . . 20K1, 20K2.

The outputs of driver 40 are connected to both ends of the primary winding of driving transformer 50. The first end of the secondary winding of driving transformer 50, denoted first output 60, is connected through the primary winding of a respective balancing transformer 80 to a first end of first linear lamp 20A1, . . . , 20K1 of each of the respective luminaires 205A, . . . , 205K. The nexus of the second end of first linear lamp 20A1, . . . , 20K1 and the first end of second linear lamp 20A2, . . . , 20K2 of each luminaire 205A, . . . , 205K, is connected through the primary windings of the respective associated pair of balancing transformers 85 arranged in series. The second end of each second linear lamp 20A2 . . . 20K2 is connected through the primary winding of a respective associated balancing transformer 80 to the second end of the secondary winding of driving transformer 50, denoted second output 70.

The secondary windings of the balancing transformers 80, 85 are connected in a closed loop, in which the polarity of the secondary windings are arranged so that voltages induced in the secondary windings are in phase and add within the closed loop. Optionally, a sense resistor RS is inserted within the loop to detect current flow. Optionally, the wires of the closed loop connecting across the length of the linear lamps, denoted 210A, 210B, are arranged in a twisted wire pair. For clarity, and to further illustrate the phase relationship of the secondary transformers, lighting arrangement 200 is illustrated with first output 60 exhibiting AC+ and second output 70 exhibiting AC−, which is appropriate for ½ the drive cycle. During the second half of the drive cycle, polarity is reversed and the direction of current flow is reversed. Current flow in the primary windings is illustrated as 1I, and current flow in the secondary loop is illustrated as 12.

Preferably, the first end of each first linear lamp 20A1, . . . , 20K1 and the second end of each second linear lamp 20A2, . . . , 20K2 are in physical proximity of driving transformer 50, e.g. on the same side of display 30 typically constituted of a metal based chassis, as driving transformer 50, and in physical proximity of first balancing transformers 80, and preferably generally define a first plane. Preferably, first linear lamps 20A1, . . . , 20K1 and second linear lamps 20A2, . . . , 20K2 generally extend axially away from the proximity of driving transformer 50, and generally define a second plane, further preferably orthogonal to the first plane.

In operation lighting arrangement 200 operates in all respects similar to the operation of lighting arrangement 100, with power for the side of all lamps not directly connected to driving transformer 50, i.e. the far or cold end, supplied by the closed loop of the secondary windings of balancing transformers 80, 85. Power is thus alternately driven into each end of each lamp 20.

Figure 3:
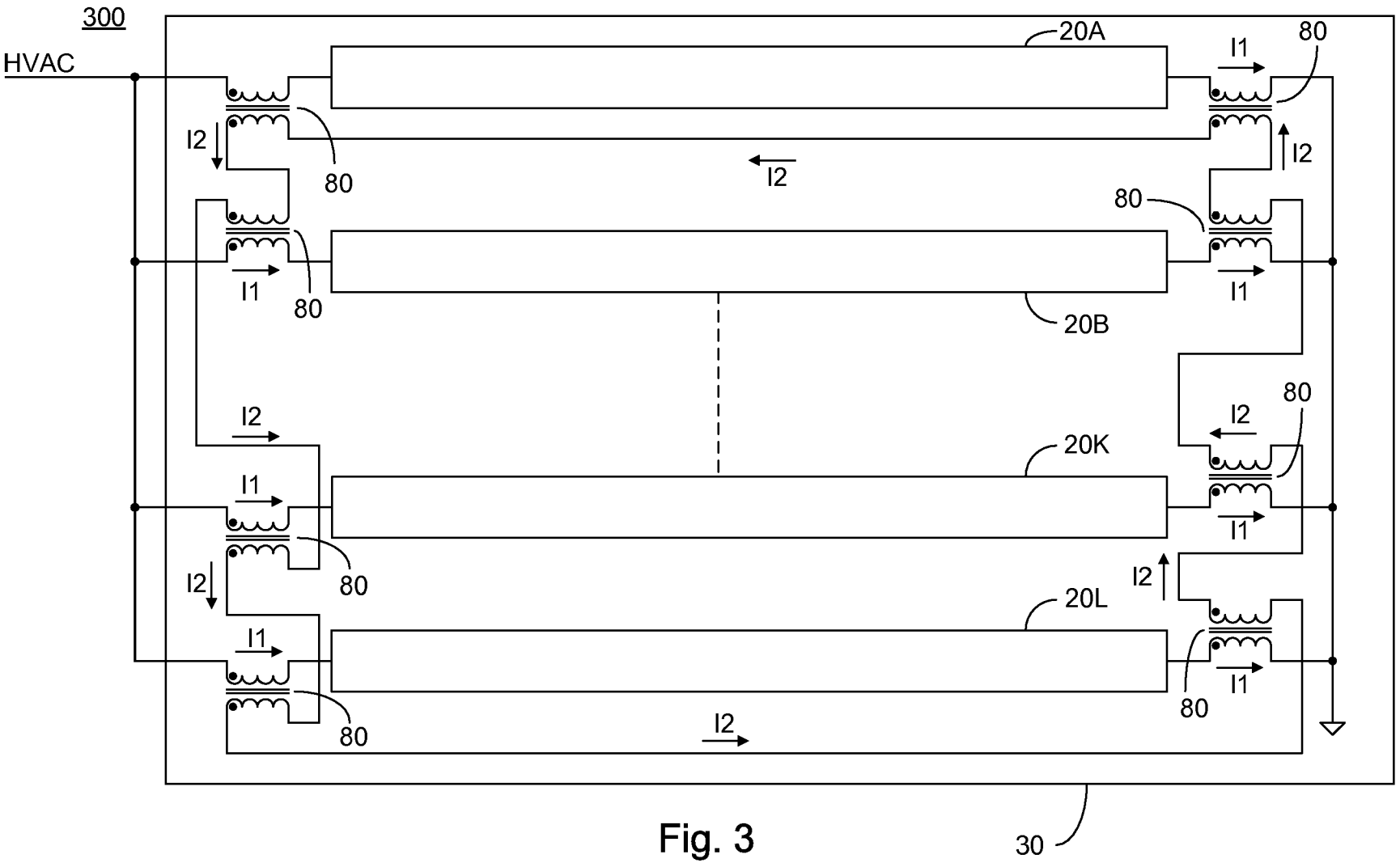
FIG. 3 illustrates a high level block diagram of an exemplary embodiment of a lighting arrangement comprising a plurality of luminaires, each constituted of a single linear lamp, and a single ended AC source.

FIG. 3 illustrates a high level block diagram of an embodiment of a lighting arrangement 300 arranged to backlight a display 30 in accordance with a principle of the invention comprising a plurality of luminaires, each constituted of a single linear lamps 20A, 20B, . . . 20K, 20L and a single ended high voltage AC source, exhibiting a common return which is typically connected to chassis ground plane, in which energy is supplied to the far end of each of the linear lamps 20A, 20B, . . . 20K, 20L by a balancing network. Grounded lighting arrangement 300 further comprises a plurality of balancing transformers 80 each associated with one end of a particular linear lamp 20A, 20B, . . . 20K, 20L. The number of lamps is shown as being divisible by 2, however this is not meant to be limiting in any way and an odd number of lamps 20 may be supplied without exceeding the scope of the invention. There are twice as many balancing transformers 80 as linear lamps.

The high voltage AC input is connected in parallel through the primary winding of a respective balancing transformer 80 to a first end of each linear lamp 20A, 20B, . . . 20L, 20K. The second end of each linear lamp 20A, 20B, . . . 20L, 20K is connected through the primary winding of the respective associated balancing transformer 80 to the common return.

The secondary windings of the balancing transformers 80 are connected in a closed loop, in which the polarity of the secondary windings are arranged so that voltages induced in the secondary windings are in phase and add within the closed loop. Optionally, a sense resistor (not shown) is inserted within the loop to detect current flow. Optionally, the wires of the closed loop connecting across the length of the linear lamps are arranged in a twisted wire pair. For clarity, and to further illustrate the phase relationship of the secondary transformers, the direction of current flow is illustrated when a positive voltage appears at the high voltage AC input, denoted HVAC. Current flow in the primary windings is illustrated as I1, and current flow in the secondary loop is illustrated as I2. Current flows in the opposite direction for each of I1 and I2 when a negative voltage, with respect to the common return, appears at HVAC.

Preferably, the first end of each linear lamp 20A, 20B . . . 20L, 20K is in physical proximity of a source driving transformer providing the HVAC, e.g. on the same side of display 30 typically constituted of a metal based chassis, as the driving transformer, and in physical proximity of the associated balancing transformers 80, and preferably generally define a first plane. Preferably, each linear lamp 20A, 20B . . . 20L, 20K generally extend axially away from the proximity of the source driving transformer providing the HVAC, and generally define a second plane, further preferably orthogonal to the first plane.

In operation, lighting arrangement 300 operates in all respects similar to the operation of lighting arrangement 200, except that all the lamps are driven with the same voltage from their hot side, i.e. the side connected to HVAC. Driving energy is coupled to the far or cold side by the closed loop of the secondary winding when a negative voltage with respect to the common return appears at input HVAC. Power is thus alternately driven into each end of each lamp 20.

Figure 4:
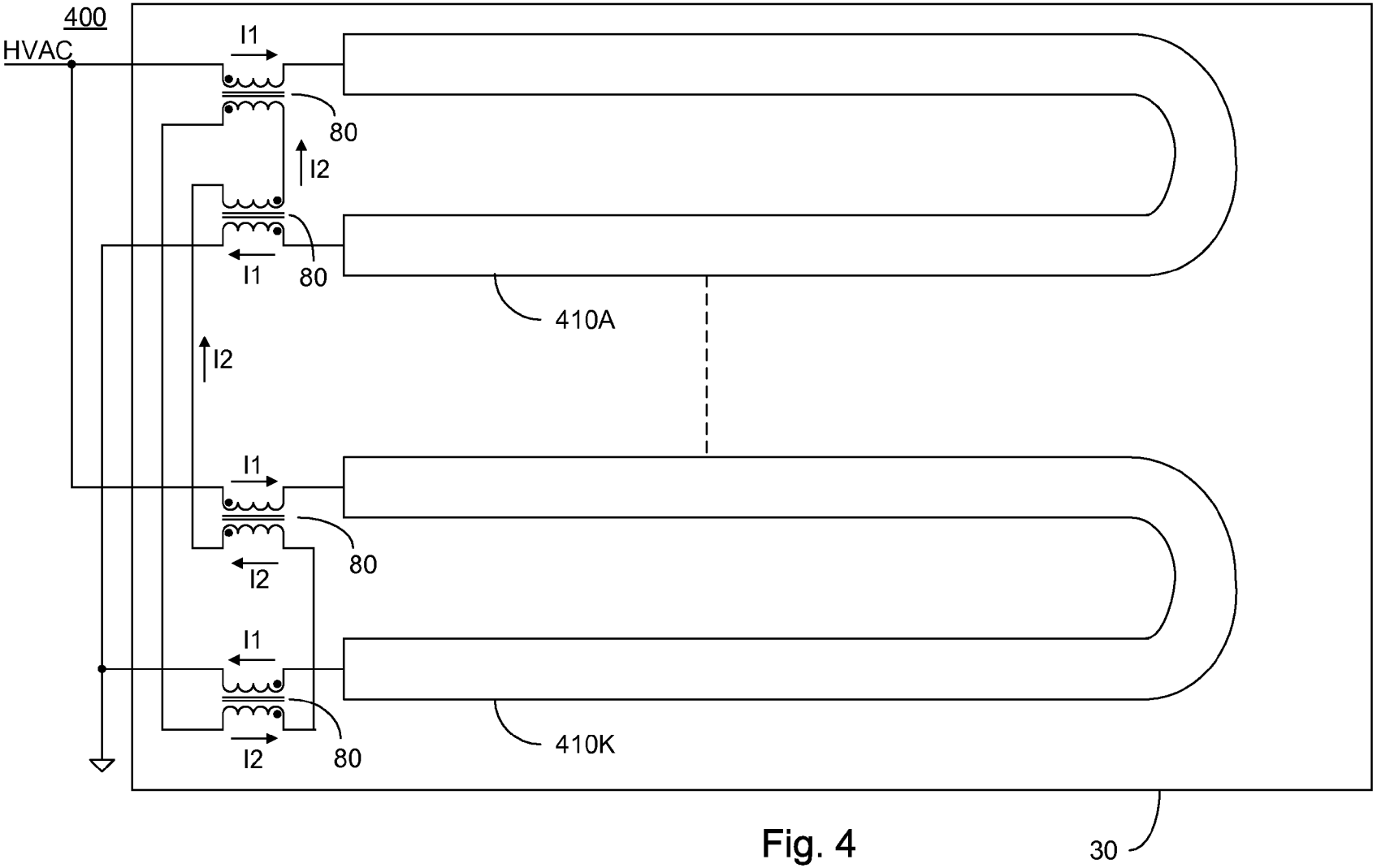
FIG. 4 illustrates a high level block diagram of an exemplary embodiment of a lighting arrangement comprising a plurality of luminaires, each constituted of a U-shaped lamp, and a single ended AC source.

FIG. 4 illustrates a high level block diagram of an embodiment of a exemplary lighting arrangement 400 arranged to backlight a display 30 comprising a plurality of luminaires, each constituted of a U-shaped lamp 410A, . . . , 410K, and a single ended AC source, exhibiting a common return which is typically connected to chassis ground plane, in accordance with a principle of the invention, in which energy is supplied to the side of each of the lamp pairs connected to the common return by a balancing network. Grounded lighting arrangement 400 further comprises a plurality of balancing transformers 80 each associated with one end of a particular U-shaped lamp 410A, . . . , 410K. There are twice as many balancing transformers 80 as U-shaped lamps 410.

The high voltage AC input is connected in parallel through the primary winding of a respective balancing transformer 80 to a first end of each U-shaped lamp 410A, . . . , 410K. The second end of each U-shaped lamp 410A, . . . , 410K is connected through the primary winding of a respective balancing transformer 80 to the common return.

The secondary windings of the balancing transformers 80 are connected in a closed loop, in which the polarity of the secondary windings are arranged so that voltages induced in the secondary windings are in phase and add within the closed loop. Optionally, a sense resistor (not shown) is inserted within the loop to detect current flow. For clarity, and to further illustrate the phase relationship of the secondary transformers, the direction of current flow is illustrated when a positive voltage appears at the high voltage AC input, denoted HVAC. Current flow in the primary windings is illustrated as I1, and current flow in the secondary loop is illustrated as I2.

Preferably, the first end and second ends of each U-shaped lamp 410A, . . . 410K are in physical proximity of a source driving transformer providing the single ended high voltage AC input, e.g. on the same side of display 30 typically constituted of a metal based chassis, as the driving transformer, and in physical proximity of the associated balancing transformers 80, and preferably generally define a first plane. Preferably, each U-shaped lamp 410A, . . . 410K generally extends axially away from the proximity of the source driving transformer providing the high voltage AC input, and generally define a second plane, further preferably orthogonal to the first plane.

In operation lighting arrangement 400 operates in all respects similar to the operation of lighting arrangement 300, with the far or cold end of the lamps 410 appearing on the same vertical plane as the hot end by the U-shape lamp arrangement. The drive power for the cold end is derived through the closed secondary winding loop as described above in relation to arrangement 300. Power is thus alternately driven into each end of each lamp 410.

Figure 5:
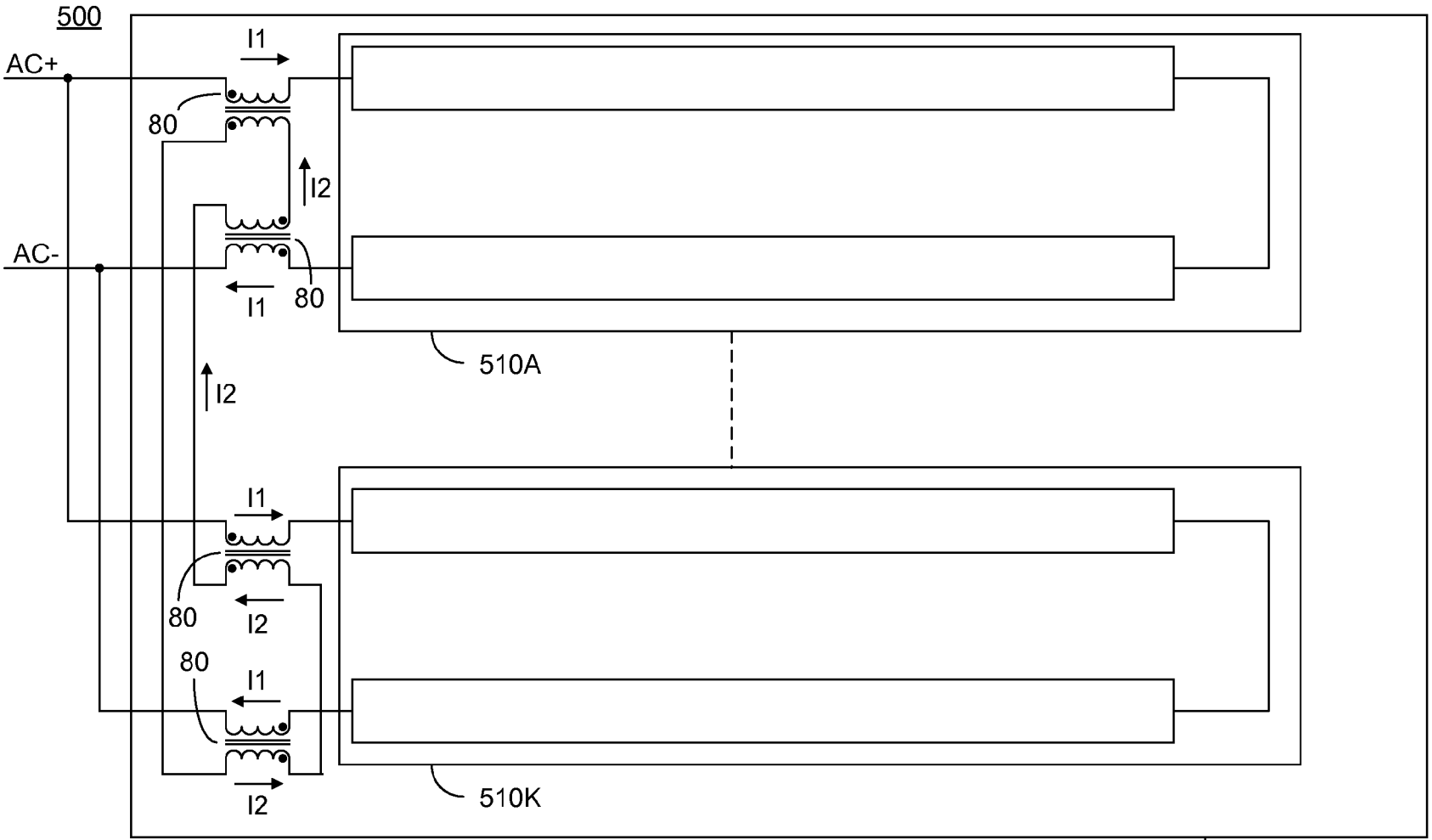
FIG. 5 illustrates a high level block diagram of an exemplary embodiment of a floating lighting arrangement comprising a plurality of luminaires, each constituted of a pair of serially coupled linear lamps, and a differential AC source.

FIG. 5 illustrates a high level block diagram of an exemplary embodiment of a floating lighting arrangement 500 arranged to backlight a display 30 comprising a plurality of luminaires 510A, . . . , 510K, each constituted of a pair of serially coupled linear lamps, and a differential AC source. Floating lighting arrangement 500 further comprises a plurality of balancing transformers 80 each associated with one end of a particular luminaire 510A, . . . , 510K. The number of balancing transformers is twice the number of luminaires 510.

One end of the differential driving AC voltage, denoted AC+, is connected in parallel through the primary winding of a respective balancing transformer 80 to a first end of each of the luminaires 510A, . . . , 510K. The second end of each luminaire 510A, . . . , 510K is connected through the primary winding of the respective associated balancing transformer 80 to the second end of the differential driving AC voltage, denoted AC−.

The secondary windings of the balancing transformers 80 are connected in a closed loop, in which the polarity of the secondary windings are arranged so that voltages induced in the secondary windings are in phase and add within the closed loop. Optionally, a sense resistor (not shown) is inserted within the loop to detect current flow. For clarity, and to further illustrate the phase relationship of the secondary transformers, the direction of current flow is illustrated when a positive voltage appears at AC+. Current flow in the primary windings is illustrated as I1, and current flow in the secondary loop is illustrated as I2.

Preferably, the first and second ends of each luminaire 510A, . . . , 510K are in physical proximity of a source driving transformer providing the differential high voltage AC input, e.g. on the same side of display 30 typically constituted of a metal based chassis, as the driving transformer, and in physical proximity of the associated balancing transformers 80, and preferably generally define a first plane. Preferably, each luminaire 510A, . . . , 510K generally extends axially away from the proximity of the source driving transformer providing the differential high voltage AC input, and generally define a second plane, further preferably orthogonal to the first plane.

In operation lighting arrangement 500 operates in all respects similar to the operation of lighting arrangement 400 and is therefore not further detailed. Disadvantageously, power is not directly driven into the far, or cold, end of each of the linear lamps of the luminaries 510A, . . . , 510K.

Figure 6:
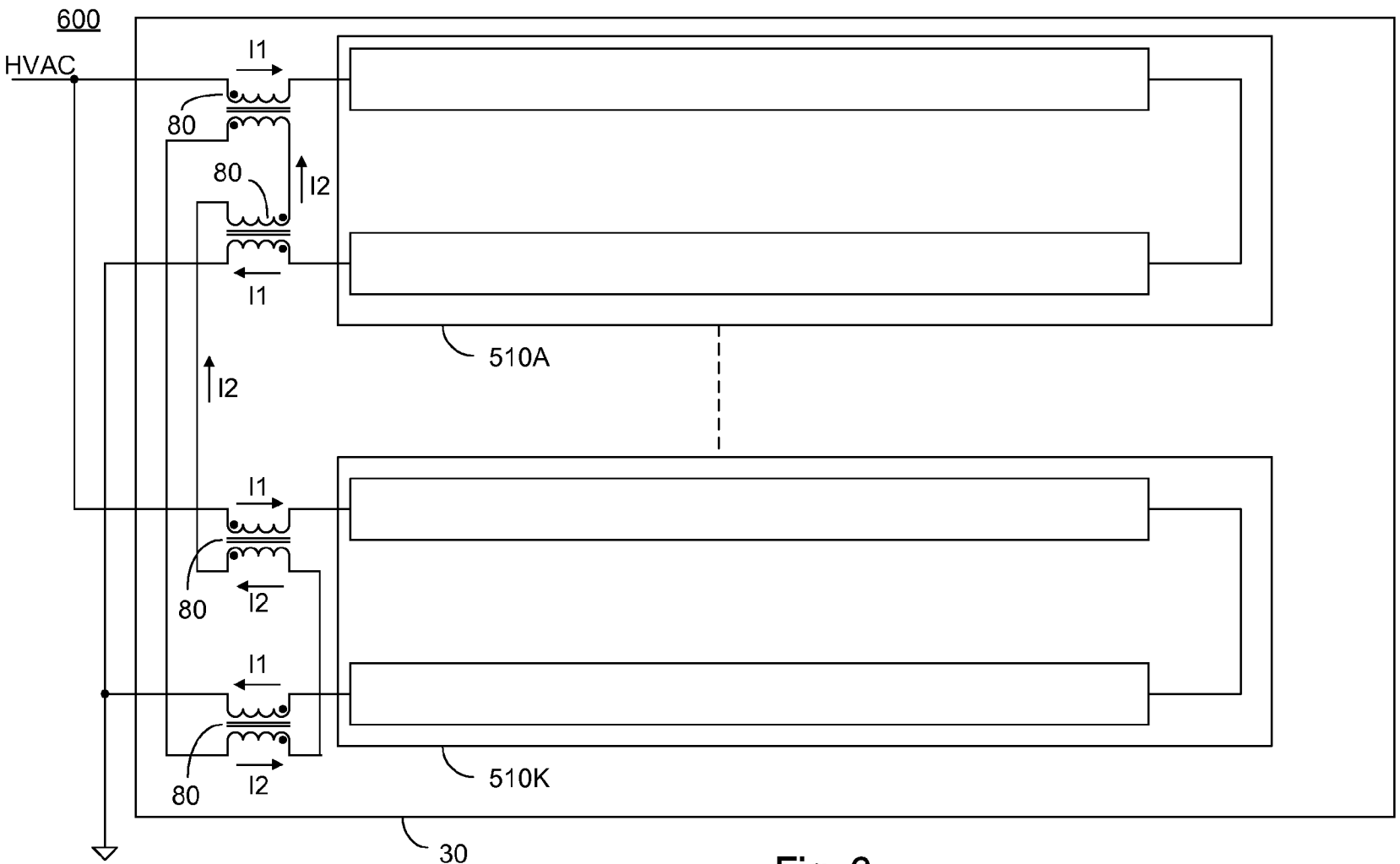
FIG. 6 illustrates a high level block diagram of an exemplary embodiment of a lighting arrangement comprising a plurality of luminaires, each constituted of a pair of serially coupled linear lamps, and a single ended AC source.

FIG. 6 illustrates a high level block diagram of an embodiment of a grounded lighting arrangement 600 arranged to backlight a display 30 in accordance with a principle of the invention comprising a plurality of luminaires 510A, . . . , 510K, each constituted of a pair of serially coupled linear lamps, and a single ended high voltage AC source, exhibiting a common return which is typically connected to a chassis ground plane. Grounded lighting arrangement 600 further comprises a plurality of balancing transformers 80 each associated with one end of a particular luminaire 510A, . . . , 510K. The number of balancing transformers is twice the number of luminaires 510.

The input of the single ended high voltage AC source is connected in parallel through the primary winding of a respective balancing transformer 80 to a first end of each of luminaires 510A, . . . , 510K. The second end of each luminaire 510A, . . . , 510K is connected through the primary winding of the respective associated balancing transformer 80 to the common return.

The secondary windings of the balancing transformers 80 are connected in a closed loop, in which the polarity of the secondary windings are arranged so that voltages induced in the secondary windings are in phase and add within the closed loop. Optionally, a sense resistor (not shown) is inserted within the loop to detect current flow. For clarity, and to further illustrate the phase relationship of the secondary transformers, the direction of current flow is illustrated when a positive voltage appears at the high voltage AC input, denoted HVAC. Current flow in the primary windings is illustrated as I1, and current flow in the secondary loop is illustrated as I2.

Preferably, the first and second ends of each luminaire 510A, . . . , 510K are in physical proximity of a source driving transformer providing the single ended high voltage AC input, e.g. on the same side of display 30 typically constituted of a metal based chassis, as the driving transformer, and in physical proximity of the associated balancing transformers 80, and preferably generally define a first plane. Preferably, each luminaire 510A, . . . , 510K generally extends axially away from the proximity of the source driving transformer providing the single ended high voltage AC input, and generally define a second plane, further preferably orthogonal to the first plane.

In operation lighting arrangement 600 operates in all respects similar to the operation of lighting arrangement 500 and is therefore not further detailed.

Figure 7:
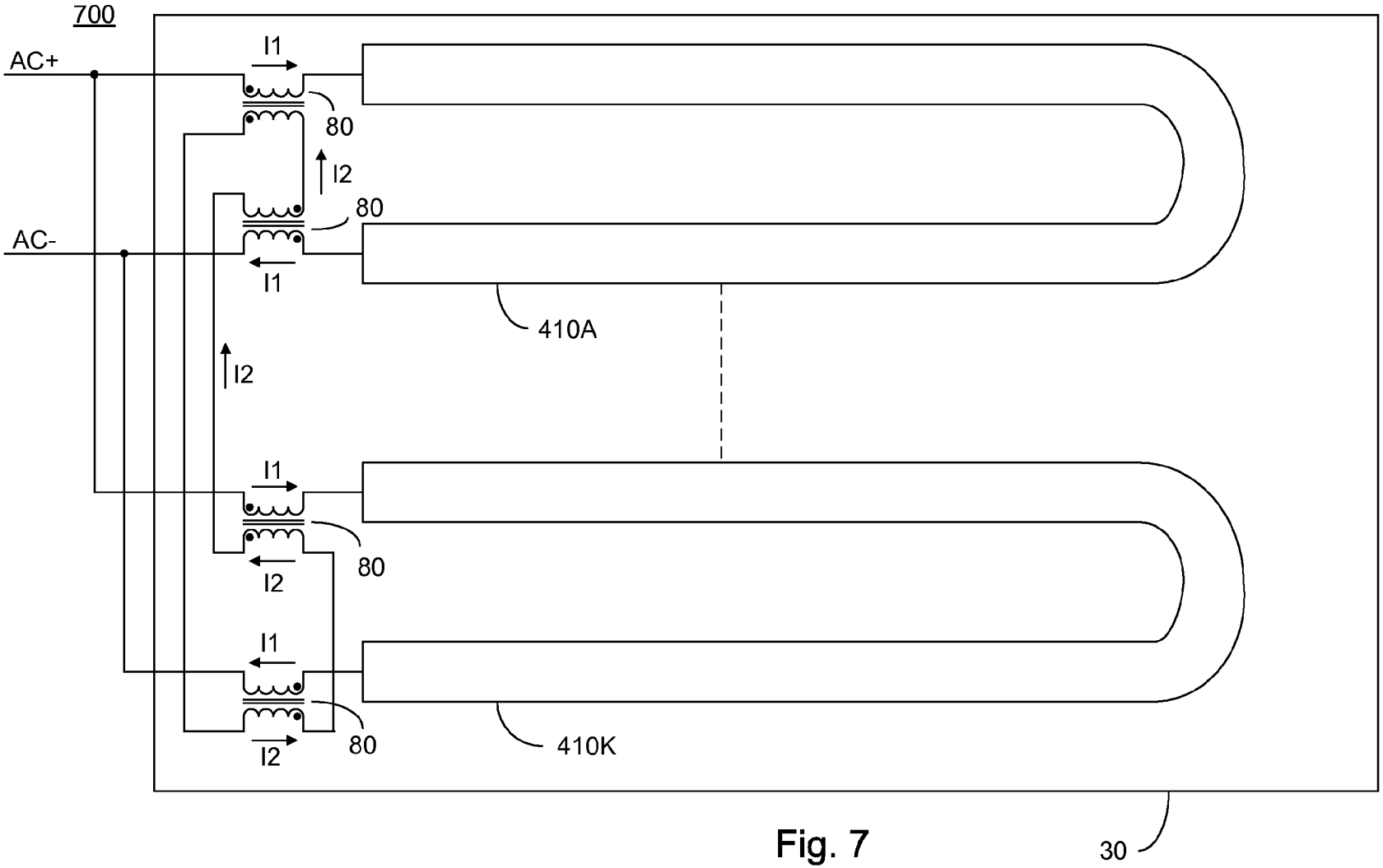
FIG. 7 illustrates a high level block diagram of an exemplary embodiment of a floating lighting arrangement comprising a plurality of luminaires, each constituted of a U-shaped lamp, and a differential AC source.

FIG. 7 illustrates a high level block diagram of an embodiment of a floating lighting arrangement 700 arranged to backlight a display 30 in accordance with a principle of the invention comprising a plurality of luminaires, each constituted of a U-shaped lamp 410A, . . . , 410K, and a differential AC source. Lighting arrangement 700 further comprises a plurality of balancing transformers 80 each associated with one end of a particular U-shaped lamp 410A, . . . , 410K. There are twice as many balancing transformers 80 as U-shaped lamps 410.

A first end of the differential AC input, denoted AC+, is connected in parallel through the primary winding of a respective balancing transformer 80 to a first end of each U-shaped lamp 410A, . . . , 410K. The second end of each U-shaped lamp 410A, . . . , 410K is connected through the primary winding of the respective associated balancing transformer 80 to the second end of the differential AC input, denoted AC−.

The secondary windings of the balancing transformers 80 are connected in a closed loop, in which the polarity of the secondary windings are arranged so that voltages induced in the secondary windings are in phase and add within the closed loop. Optionally, a sense resistor (not shown) is inserted within the loop to detect current flow. For clarity, and to further illustrate the phase relationship of the secondary transformers, the direction of current flow is illustrated when a positive voltage appears at first input AC+. Current flow in the primary windings is illustrated as I1, and current flow in the secondary loop is illustrated as I2.

Preferably, the first and second ends of each U-shaped lamp 410A, . . . 410K are in physical proximity of a source driving transformer providing the differential AC input, e.g. on the same side of display 30 typically constituted of a metal based chassis, as the driving transformer, and in physical proximity of the associated balancing transformers 80, and preferably generally define a first plane. Preferably, each U-shaped lamp 410A, ... 410K generally extends axially away from the proximity of the source driving transformer providing the differential AC input, and generally define a second plane, further preferably orthogonal to the first plane.

In operation lighting arrangement 700 operates in all respects similar to the operation of lighting arrangement 400 and is therefore not further detailed.

Figure 8:
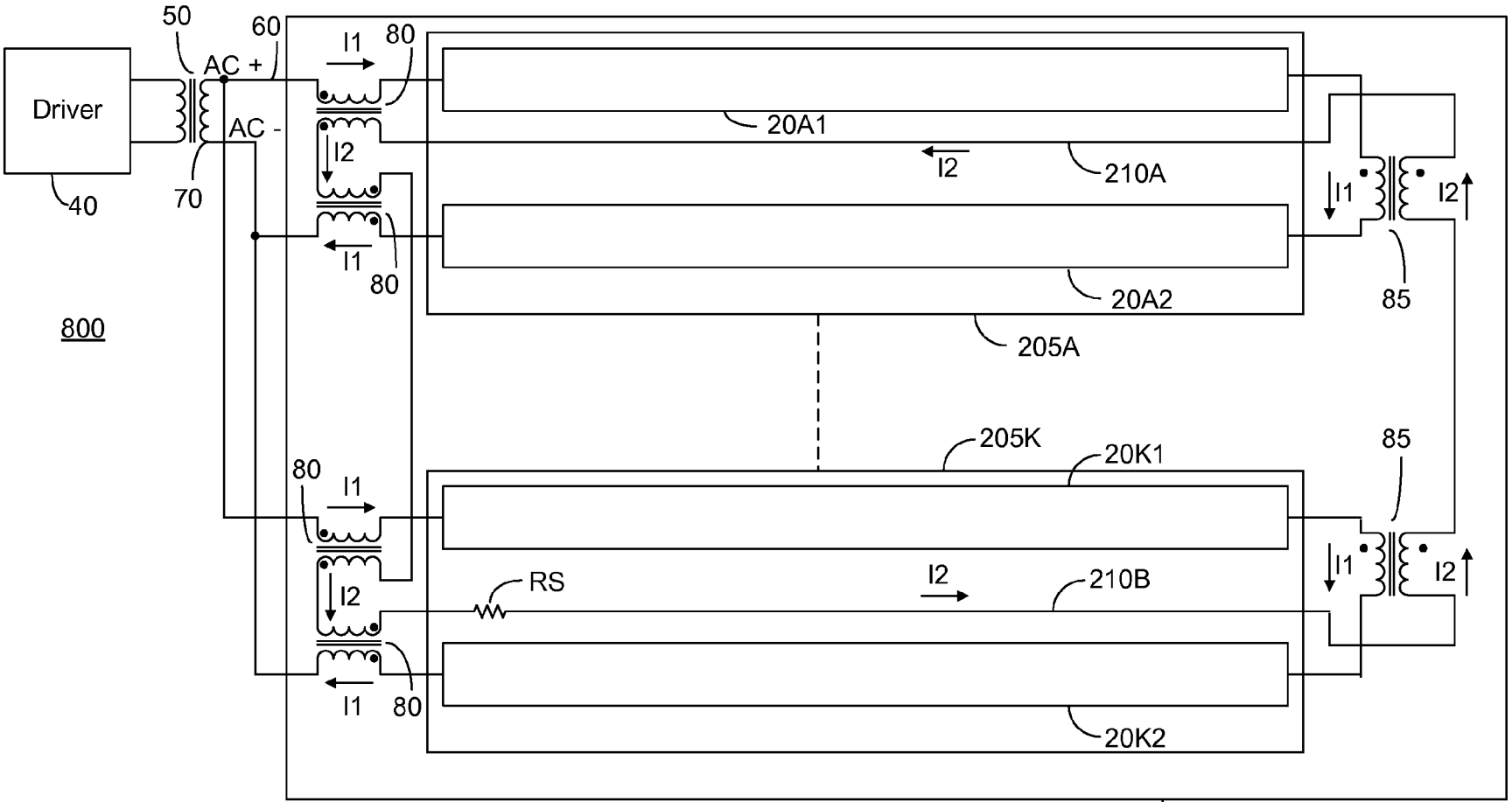
FIG. 8 illustrates a high level block diagram of an exemplary embodiment of a floating lighting arrangement comprising a plurality of luminaires, each constituted of a linear lamp pair, each of the linear lamp pairs sharing a single balancing transformer at the far end, and a differential AC source, in which energy is supplied to the far side of each of the lamp pairs by a balancing network.

FIG. 8 illustrates a high level block diagram of an embodiment of a floating lighting arrangement 800 in accordance with a principle of the invention comprising a plurality of luminaries 205A, . . . , 205K, each constituted of a serially arranged linear lamp pair, 20A1, 20A2 . . . 20K1, 20K2, and a differential AC source in which energy is supplied to the far end of each of the lamp pairs by a balancing network, Floating lighting arrangement 800 comprises: a driver 40; a driving transformer 50 exhibiting a first output 60 and a second output 70; a plurality of balancing transformers 80; a plurality of balancing transformers 85; and a wire pair 210A, 210B. Each luminaire 205A, . . . , 205K has associated therewith a balancing transformer 80 associated with a first end thereof and a balancing transformer 80 associated with a second end thereof. A single balancing transformer 85 serially connects the far ends of the lamps of each linear lamp pair 20A1, 20A2 . . . 20K1, 20K2.

The outputs of driver 40 are connected to both ends of the primary winding of driving transformer 50. The first end of the secondary winding of driving transformer 50, denoted first output 60, is connected through the primary winding of a respective balancing transformer 80 to a first end of first lamp 20A1, . . . , 20K1 of each of the respective luminaires 205A, . . . , 205K. The nexus of the second end of the respective first lamp 20A1, . . . , 20K1 and the first end of the respective second lamp 20A2, . . . , 20K2 of each luminaire 205A, . . . , 205K, is connected through the primary winding of the respective associated balancing transformer 85. The second end of each second lamp 20A2 . . . 20K2 is connected through the primary winding of the respective associated balancing transformer 80 to the second end of the secondary winding of driving transformer 50, denoted second output 70.

The secondary windings of the balancing transformers 80, 85 are connected in a closed loop, in which the polarity of the secondary windings are arranged so that voltages induced in the secondary windings are in phase and add within the closed loop. Optionally, a sense resistor RS is inserted within the loop to detect current flow. Optionally, the wires of the closed loop connecting across the length of the linear lamps, denoted 210A, 210B, are arranged in a twisted wire pair. For clarity, and to further illustrate the phase relationship of the secondary transformers, lighting arrangement 800 is illustrated with first output 60 exhibiting AC+and second output 70 exhibiting AC−, which is appropriate for ½ the drive cycle. During the second half of the drive cycle, polarity is reversed and the direction of current flow is reversed. Current flow in the primary windings is illustrated as Il, and current flow in the secondary loop is illustrated as I2.

Preferably, the first end of each first linear lamp 20A1, . . . , 20K1 and the second end of each second linear lamp 20A2, . . . , 20K2 are in physical proximity of driving transformer 50, e.g. on the same side of display 30 typically constituted of a metal based chassis, as driving transformer 50, and in physical proximity of first balancing transformers 80, and preferably generally define a first plane. Preferably, first linear lamps 20A1, . . . , 20K1 and second linear lamps 20A2, . . . , 20K2, typically constituted of linear lamps, generally extend axially away from the proximity of driving transformer 50, and generally define a second plane, further preferably orthogonal to the first plane.

In operation lighting arrangement 800 is in all respects similar to lighting arrangement 200, with a single balancing transformer shared between the linear lamp pairs of each luminaire 205. Arrangement 800 reduces the amount of balancing transformers required at the far end. Disadvantageously, the driving voltage developed at the far end of the lamps is half of that supplied by arrangement 200 if the same type of balancing transformer is used. There is no requirement that the same balancing transformers be utilized, and balancing transformers 85 of arrangement 800 may be supplied with double the turns ratio to compensate for the reduced driving voltage.

Arrangement 800 exhibits a drive at each of the lamps 20, as contrasted with arrangement 500 in which drive for the nexus of the serially connected lamps is not supplied.

Thus certain of the present embodiments enable a backlighting arrangement in which pairs of balancing transformers are provided, each associated with a particular luminaires The primary winding of each of the balancing transformers is coupled in series with a respective end of the associated luminaires The secondary windings of the balancing transformers are connected in a single closed loop, and arranged to be in-phase.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

I claim:

1. A backlighting arrangement comprising:

a first lead and a second lead arranged to receive and return an alternating current;

at least one luminaire, each of said at least one luminaire comprising a pair of linear lamps each lamp of said pair exhibiting a far end removed from each of a first and a second end of said luminaire;

at least one first balancing transformer pair, each of said first balancing transformer pair associated with a particular one of said at least one luminaire, the primary winding of a first balancing transformer of each of said first balancing transformer pair serially coupled between said first lead and the first end of said associated at least one luminaire, and the primary winding of a second balancing transformer of each of said first balancing transformer pair serially coupled between said second lead and the second end of each of said associated at least one luminaire; and at least one second balancing transformer pair, each of said second balancing transformer pair associated with a particular one of said at least one luminaire, the primary windings of said second balancing transformer pair being arranged in series with, and serially coupled between, said far ends of the associated pair of linear lamps of said particular luminaire, wherein the secondary windings of all of said at least one first balancing transformer pair and said at least one second balancing transformer pair are serially connected in a closed in-phase loop.

2. A backlighting arrangement according to claim 1, further comprising a differential alternating current source arranged to supply power to said at least one luminaire via said first and second leads.

3. A backlighting arrangement according to claim 1, further comprising a sense resistor serially connected within said serially connected closed in-phase loop arranged to present a voltage drop representation of the current flowing through the closed in-phase loop.

4. A backlighting arrangement comprising:

a first lead and a second lead arranged to receive and return an alternating current;

at least one luminaire, each of said at least one luminaire comprising a pair of linear lamps each exhibiting a far end removed from each of a first and a second of said luminaire;

at least one first balancing transformer pair, each of said first balancing transformer pair associated with a particular one of said at least one luminaire, the primary winding of a first balancing transformer of each of said first balancing transformer pair serially coupled between said first lead and a first end of said associated at least one luminaire, and the primary winding of a second balancing transformer of each of said first balancing transformer pair serially coupled between said second lead and a second end of each of said associated at least one luminaire; and at least one second balancing transformer, each of said at least one second balancing transformer associated with a particular one of said pair of linear lamps, the primary winding of each of said second balancing transformer coupled between said far ends of said associated pair of linear lamps, wherein the secondary windings of all of said at least one first balancing transformer pair and said at least one second balancing transformer are serially connected in a closed in-phase serial loop.

5. A backlighting arrangement according to claim 1, wherein said at least one pair of linear lamps are arranged substantially in parallel to backlight a display, and wherein said serially connected closed in-phase loop exhibits a single twisted wire pair connecting a portion of the closed in-phase loop associated with a first end of the display to a portion of the closed in-phase loop associated with a second end of the display opposing said first end of the display.

6. A backlighting arrangement according to claim 1, wherein said at least one luminaire comprises a plurality of luminaires.

7. A method of driving at least one luminaire, comprising:

receiving an alternating current;

providing at least one luminaire, each of said provided at least one luminaire comprising a pair of linear lamps each exhibiting a far end removed from each of a first end and a second end of said provided luminaire;

providing at least one first balancing transformer pair, each of said provided first balancing transformer pair associated with a particular one of said provided at least one luminaire, the primary winding of a first transformer of the respective provided first balancing transformer pair associated with a first end of said associated luminaire, and the primary winding of a second transformer of the respective first balancing transformer pair associated with a second end of said associated luminaire;

providing at least one second balancing transformer pair, each balancing transformer of said pair associated with a particular one of said pair of linear lamps of a particular one of said provided at least one luminaire;

arranging the primary windings of said second balancing transformer pair in series and serially connecting the series arranged primary windings between said far ends of said associated pair of linear lamps;

coupling said received alternating current via said respective primary windings of said provided first balancing transformer pair to each end of said provided at least one luminaire; and arranging the secondary windings of all of said provided at least one first balancing transformer pair and said provided at least one second balancing transformer pair in a serially connected closed in-phase loop.

8. A method according to claim 7, further comprising sensing a current flowing through the closed in-phase loop.

9. A method according to claim 7, further comprising sensing a current flowing through the closed in-phase loop.

10. A method of driving at least one luminaire, comprising:

receiving an alternating current;

providing at least one luminaire, each of said provided at least one luminaire comprising a pair of linear lamps each exhibiting a far end removed from each of a first and a second end of said luminaire;

providing at least one first balancing transformer pair, each of said provided at least one first balancing transformer pair associated with a particular one of said provided at least one luminaire, the primary winding of a first transformer of the respective provided first balancing transformer pair associated with a first end of said associated luminaire, and the primary winding of a second transformer of the respective first balancing transformer pair associated with a second end of said associated luminaire;

coupling said received alternating current via said respective primary windings of said provided first balancing transformer pair to each end of said provided at least one luminaire;

providing at least one second balancing transformer, each of said provided at least one second balancing transformer associated with a particular one of said provided at least one luminaire;

serially connecting the primary winding of one of said provided at least one second balancing transformer between said far ends of said respective associated pair of linear lamps of said particular associated luminaire; and arranging the secondary windings of all of said provided at least one first balancing transformer pair and said provided at least one second balancing transformer in a serially connected closed in-phase loop.

11. A backlighting arrangement comprising:

a means for receiving an alternating current exhibiting a first lead and a second lead;

a plurality of luminaires; and a plurality of first balancing transformer pairs, each of said first balancing transformer pairs associated with a particular one of said plurality of luminaires, the primary winding of a first balancing transformer of each first balancing transformer pair serially coupled between said first lead of said means for receiving an alternating current and a first end of the associated luminaire, and the primary winding of a second balancing transformer of each of said first balancing transformer pair serially coupled between said second lead of said means for receiving an alternating current and a second end of the associated luminaire; and a plurality of second balancing transformer pairs each associated with a particular one of said plurality of luminaires and wherein each of said plurality of luminaires comprises a pair of linear lamps each exhibiting a far end removed from each of said first and second ends of said luminaire, the primary windings of said associated second balancing transformer pair being arranged in series and serially connected between said far ends of said pair of linear lamps;

wherein the secondary windings of all of said plurality of first balancing transformer pair and said plurality of second balancing transformer pairs are serially connected in a closed in-phase loop.

* * * * *